United States Patent [19]

Onischin et al.

[11] 4,445,932

[45] May 1, 1984

[54] METHOD OF RECOVERING FERRONICKEL FROM OXIDATED NICKEL ORES

[75] Inventors: Boris P. Onischin; Valery D. Linev, both of Leningrad; Alexandr E. Burochkin, Kirovogradskaya; Sergei G. Mitsev, Kirovogradskaya; Viktor R. Keller, Kirovogradskaya; Ivan S. Chernyshev, Kirovogradskaya; Viktor V. Lakisov, Kirovogradskaya; Valentin P. Moiseev, Kirovogradskaya; Jury A. Romanenkov, Leningrad; Tamerlan G. Khakimov, Kirovogradskaya, all of U.S.S.R.

[73] Assignee: Gosudarstvenny Proektny I Nauchno-Issledovatelsky Institut Gipronikel, Leningrad, U.S.S.R.

[21] Appl. No.: 397,415

[22] Filed: Jul. 12, 1982

[51] Int. Cl.[3] ..... C22B 23/02; C22B 4/04; C21B 11/10

[52] U.S. Cl. ..... 75/11; 75/82; 75/1 R

[58] Field of Search ..... 75/10 R, 11, 82, 1 R

[56] References Cited

U.S. PATENT DOCUMENTS

| | | | |
|---|---|---|---|
| 2,573,153 | 10/1951 | Lichty | 75/82 |
| 3,077,396 | 2/1963 | Moussoulos | 75/82 |
| 3,167,420 | 1/1965 | Robiette | 75/11 |

*Primary Examiner*—M. J. Andrews

*Attorney, Agent, or Firm*—McAulay, Fields, Fisher, Goldstein & Nissen

[57] ABSTRACT

Disclosed is a method of recovering ferronickel from oxidated nickel ores, comprising preparing of a charge accompanied by roasting ore, a reducing agent and flux, followed by electric smelting of the charge. According to the proposed method, roasting of the ore with the reducing agent and roasting of the flux are carried out separately.

20 Claims, No Drawings

METHOD OF RECOVERING FERRONICKEL FROM OXIDATED NICKEL ORES

FIELD OF THE INVENTION

The present invention relates to the production of ferroalloys by reduction electric smelting of the ore. More particularly, the present invention relates to a method of recovering ferronickel from oxidated nickel ores. The present invention can be most advantageously used for processing low-grade ores with a high content of silica.

BACKGROUND OF THE INVENTION

The well-known prior art methods of recovering ferronickel from oxidated nickel ores comprise preparing of a charge accompanied by roasting ore, a reducing agent and flux, and followed by electric smelting of the charge. Any solid carbonaceous reducing agent, preferably the anthracite culm, can be suitably used as the reducing agent. Limestone, dolomite, or dolomitic limestone are used as the flux. The amount of the reducing agent and the flux required is determined by the ore composition. Any of such methods is an analog of the present invention.

In the above methods, the reducing agent and the flux are added to the ore prior to its processing in the roasting furnace, thus simultaneously performing the roasting of all components of the charge fed for electric smelting. In the course of roasting, a partial reduction of metal oxides and a partial binding of the free silica occur. However, adequate conditions cannot be provided for the optimal performing of both reactions in one roasting furnace. This is caused by the fact that the intensive thermal decomposition of the used flux with the isolation of the sufficient amount of lime binding free silica is provided, mainly, at temperatures above 1000° C. However, at this temperature the melting of the ore components occurs, leading to the formation of skulls in the roasting furnace. On the other hand, if the roasting temperature is lower than the temperature of intensive flux decomposition, this leads to worse technical- and -economic indices of the electric smelting process. The latter manifests in an increase in the power consumption to provide the complete thermal flux decomposition and in a higher consumption of the reducing agent reacting with the carbon dioxide formed as a result of the thermal decomposition of the flux and leads to a quicker destruction of the electric roasting furnace crown and, hence, to a reduction in its utilization factor. These circumstances are especially essential in the processing of low-grade ores with a high content of silica, that require the addition of relatively large amounts of flux, ranging from 20% of the dry ore weight and over.

SUMMARY OF THE INVENTION

The primary object of the present invention is to provide a method of recovering ferronickel from oxidated nickel ores, providing the most favourable conditions for processing low-grade ores with a high content of silica.

Another object of the present invention is to provide a method of recovering ferronickel from oxidated nickel ores, providing more complete thermal flux decomposition in the course of charge preparation for electric smelting.

Still another object of the present invention is to provide a method of recovering ferronickel from oxidated nickel ores, reducing the consumption of the reducing agent used for recovering ferronickel from oxidated nickel ores.

A further object of the present invention is to provide a method of recovering ferronickel from oxidated nickel ores, reducing the rate of gasification of carbon contained in the reducing agent, thus increasing the utilization factor of the electric furnace.

A still further object of the present invention is to provide a method of recovering ferronickel from oxidated nickel ores, preventing the formation of skulls in the roasting furnace.

A yet further object of the present invention is to provide a method of recovering ferronickel from oxidated nickel ores, that ensures the achievement of all objects mentioned hereinabove without substantial complication of the production process used for recovering ferronickel from oxidated nickel ores.

With these and other objects in view, there is provided a method of recovering ferronickel from oxidated nickel ores, comprising preparing of a charge, accompanied by roasting ore, an reducing agent and flux, and followed by electric smelting of the charge, wherein, according to the present invention, roasting of the ore with the reducing agent and roasting of the flux are carried out separately, while their mixing is performed prior to the supply into the electric furnace. As a result of such an arrangement it becomes possible to provide the optimal conditions for both roasting of the ore with the reducing agent and roasting of the flux, thus permitting the above-mentioned problems to be solved with any required amount of the flux.

When the basic arrangement is implemented, it is advisable to accomplish roasting of the ore with the reducing agent and roasting of the flux in parallel, in continuously operating roasting furnaces and to supply continuously the roasted flux into the unloading channel of a hot cinder obtained by roasting the ore with the reducing agent. This provides a good mixing of the hot cinder with the flux without any additional power consumption to carry out this operation.

Other and further objects and advantages of the invention will be better understood from the following description illustrating the preferred embodiments of the invention.

DETAILED DESCRIPTION OF THE INVENTION

The present invention is explained by its implementation for the ores of the Pobuzh deposit in the Soviet Union at the stage of an experimental industrial development work. These ores have the following composition in weight percent: nickel, 0.9; silica, 43.5; iron, 22.5; magnesium oxide, 4.5; aluminium dioxide, 4.5; calcium oxide, 1.5; the balance being attendant impurities. This ore was processed to recover ferronickel.

The ore processing was accomplished in two stages. In the first stage, the charge was prepared. Two parallelly operating, rotary tube furnaces were used for this purpose. One of them having the capacity of 1200 t/day was loaded with the ore and the reducing agent with the weight ratio of 100:10.5, respectively. Used as the reducing agent was anthracite culm having the following composition in weight percent: carbon, 6.5; ash, 25; the balance being volatile substances and moisture. The temperature conditions of this furnace were maintained so as to provide the maximum possible reduction of metal oxides and, at the same time, to avoid the ore melting. This was achieved in the conventional way using the monitoring of the temperature conditions in the roasting furnace. In the reduction zone of the roasting furnace the maximum temperature did not exceed 875° C. The second rotary tube furnace was used to roast the flux. The limestone comprising 52 weight percent of the bound carbon dioxide was used as the flux. The capacity of this furnace was 400 t/day so as to provide the manufacture of the product including the lime in the amount of 20% of the weight of the hot cinder that was obtained in the first of the above-mentioned roasting furnaces. The temperature conditions of this furnace were maintained so as to provide the maximum possible thermal flux decomposition. The average temperature in the roasting zone was approximately 1100° C. This was the optimal temperature conditions for the flux decomposition that provided the isolation of over 70% of free calcium oxide. The limestone consumption was 40% of the weight of the hot cinder produced as result of roasting the ore in the first rotary tube furnace. The roasted limestone incorporating 70% by weight and over of free calcium oxide was continuously supplied into an unloading channel of the furnace, used for roasting the ore with the reducing agent. This provided the constant mixing of the hot cinder produced in this furnace with the limestone roasting product.

Next, the hot cinder obtained as a result of the roasting of the ore was supplied with the reducing agent and the flux into an ore-smelting electrical furnace. An ore-smelting electrical furnace with the established power of 40 MVA was used for the electric smelting. The electric smelting was performed under the common conditions. When discharged, the slag temperature was approximately 1350° C. and the ferronickel temperature was 1220° C. The conditions of the electric smelting were common.

Given for comparison in tables 1 and 2 are the characteristics of products of the electric smelting as well as the technical-and-economic indices of this process as obtained in the course of recovery of ferronickel from the ore described hereinabove with the use of the known prior art method and the method in accordance with the essence of the present invention. Given below are average values obtained for a 25-day operation with the use of the known prior art production process and the proposed production process.

TABLE 1

Comparative technical-and-economic indices of the ferronickel recovering processes using the prior art method and method in accordance with the present invention

| Nos. 1 | Indices 2 | | Process procedure according to the known prior art method 3 | Process procedure according to the herein-proposed method 4 |
|---|---|---|---|---|
| 1. | Consumption of reducing agent in weight % of hot cinder | | 8.15 | 7.9 |
| 2. | Consumption of limestone in weight % of hot cinder | | 40.00 | 40.00 |
| 3. | Melting, t/day | Hot cinder | 800 | 920 |
| | | Ore | 652 | 818 |
| 4. | Specific consumption of electric power, KW-day/ore ton | | 813 | 694 |
| 5. | Yield, | Slag | 736 | 798 |

TABLE 1-continued

Comparative technical-and-economic indices of the ferronickel recovering processes using the prior art method and method in accordance with the present invention

| Nos. 1 | Indices 2 | | Process procedure according to the known prior art method 3 | Process procedure according to the herein-proposed method 4 |
|---|---|---|---|---|
| | t/day | Ferronickel | 118 | 127 |
| 6. | Temperature, °C. | Slag | 1400 | 1350 |
| | | Ferronickel | 1230 | 1220 |

TABLE 2

Comparison of the amounts of components obtained in the course of ferronickel recovering processes with use of prior art method and method in accordance with present invention

| Nos. 1 | Components, weight, % 2 | | Process procedure according to the known prior art method 3 | Process procedure according to the herein-proposed method 4 |
|---|---|---|---|---|
| 1 | In slag | nickel | 0.06 | 0.05 |
| | | iron | 8.7 | 8.5 |
| | | silica | 51.1 | 52.1 |
| | | calcium oxide | 28.4 | 25.1 |
| | | magnesium oxide | 5.5 | 6.0 |
| 2 | In ferro-nickel | nickel | 5.2 | 5.3 |
| | | iron | 84.5 | 85.0 |
| | | silicon | 4.2 | 5.5 |
| | | chromium | 1.8 | 1.8 |
| | | carbon | 2.1 | 2.2 |

As seen from Table 1, the method according to the present invention provides the recovery of ferronickel from oxidated nickel ores with a high content of silica with lower power consumption as compared to the known prior art method. This reduction in the power consumption was accompanied by an increase in the amount of smelted ore. The consumption of the reducing agent is decreased. As it is seen from Table 2, the composition of the slag and the electric smelting product obtained with the use of the method described in the example and with the use of the prior art method differ insignificantly. However, it is to be noted, that when the proposed method is used, the content of nickel and iron was slightly reduced in the slag, while the content of the same elements was slightly increased in the electric smelting product. All this was achieved owing to the fact that the optimal conditions were provided for roasting of the ore with the reducing agent and for roasting of the flux in accordance with the present invention. At the same time it is clear from the detailed description of the invention that no special equipment is required for implementation thereof while the process of production of ferronickel from oxidated nickel ores has not become more complicated as compared to the prior art method.

What we claim is:

1. A method of recovering ferronickel from oxidated nickel ores, comprising the steps of:

preparing an initial charge of ore with a reducing agent, roasting the initial charge and producing a hot cinder in one roasting furnace, simultaneously and independently roasting flux in another roasting furnace, mixing said hot cinder and said hot roasted flux, thus producing a ready-for-use charge, and electrically smelting said charge.

2. A method as defined in claim 1, wherein continuous roasting furnaces are used as said roasting furnaces and during the operation thereof said roasted flux is continuously supplied from one of said furnaces into said hot cinder at the outlet of the other of said furnaces.

3. The method as defined in claim 1, wherein the ore has the following composition in weight percent: 0.9 nickel, 43.5 silica, 22.5 iron, 4.5 magnesium oxide, 4.5 aluminum dioxide, 1.5 calcium oxide, and the balance is attendant impurities.

4. The method as defined in claim 1, wherein the reducing agent is anthracite culm having the following composition in weight percent: 6.5 carbon, 25 ash, and the balance is volatile substances and moisture.

5. The method as defined in claim 1, wherein the initial charge is roasted at a maximum temperature of 875° C. and the flux is roasted at an average temperature of 1100° C.

6. The method as defined in claim 1, wherein the roasting of the ore with the reducing agent and the roasting of the flux are carried out separately in their respective continuously operating independent roasting furnaces.

7. The method of claim 6, wherein the roasted flux is continuously supplied into the hot cinder of the ore furnace.

8. The method as defined in claim 1, wherein the one furnace is loaded with the ore and the reducing agent with a weight ratio of 100:10.5.

9. The method as defined in claim 1, wherein two separate simultaneously operating rotary tube furnaces are used, the ore roasting furnace for roasting the ore having a maximum temperature of 875° C. in the reduction zone, and the flux roasting furnace having a temperature of approximately 1100° C. in the roasting zone.

10. The method as defined in claim 1, wherein said ready-for-use charge is smelted electrically in an ore-smelting electrical furnace.

11. The method as defined in claim 1, wherein the slag temperature is 1350° C. and the ferronickel temperature is 1220° C. after the smelting.

12. A method of recovering ferronickel from oxidated nickel ores, comprising the steps of:

preparing an initial charge of nickel ore with a reducing agent, roasting the initial charge and producing a hot cinder in one roasting furnace, simultaneously and independently roasting limestone flux in another roasting furnace, mixing said hot cinder and said hot roasted limestone flux in an unloading channel of the one roasting furnace to provide constant mixing of the hot cinder produced in the furnace with the limestone, thus producing a ready-for-use charge, and smelting said ready-for-use charge in an electric furnace.

13. The method as defined in claim 12, wherein the ore has the following composition in weight percent: 0.9 nickel, 43.5 silica, 22.5 iron, 4.5 magnesium oxide, 4.5 aluminum dioxide, 1.5 calcium oxide, and the balance is attendant impurities; and the reducing agent is anthracite culm having the following composition in weight percent: 6.5 carbon, 25 ash, and the balance is volatile substances and moisture.

14. The method as defined in claim 13, wherein the initial charge is roasted at a maximum temperature of 875° C. and the flux is roasted at an average temperature of 1100° C. to provide isolation of over 70% of free calcium oxide while the limestone consumption is 40% of the weight of the hot cinder produced as a result of roasting of the ore in said one roasting furnace.

15. The method as defined in claim 14, wherein the roasting of the ore with the reducing agent and the roasting of the flux are carried out separately at the same time in their respective continuously operating independent roasting furnaces.

16. The method of claim 15, wherein the roasted flux is continuously supplied into the hot cinder of the ore furnace.

17. The method as defined in claim 16, wherein the slag temperature is 1350° C. and the ferronickel temperature is 1220° C. after the smelting.

18. A method of recovering ferronickel from low-grade oxidated nickel ores with a high silica content, comprising the steps of:

preparing an initial charge of ore with a reducing agent, roasting the initial charge of ore and producing a hot cinder in one roasting furnace, simultaneously and independently roasting limestone flux in another roasting furnace so that the roasting of the ore with the reducing agent and flux roasting are separately carried out, mixing said hot cinder and said hot roasted flux, thus producing a ready-for-use charge, and electrically smelting said ready-for-use charge in an electric furnace.

19. The method as defined in claim 18, wherein the ore has the following composition in weight percent: 0.9 nickel, 43.5 silica, 22.5 iron, 4.5 magnesium oxide, 4.5 aluminum dioxide, 1.5 calcium oxide, and the balance is attendant impurities.

20. The method as defined in claim 19, wherein two separate and simultaneously operating rotary tube furnaces are used, the ore roasting furnace for roasting the ore having a maximum temperature of 875° C. in the reduction zone, and the flux roasting furnace having a temperature of approximately 1100° C. in the roasting zone.

* * * * *